US011059037B1

(12) United States Patent
Sternick

(10) Patent No.: US 11,059,037 B1
(45) Date of Patent: Jul. 13, 2021

(54) SAMPLE MANIPULATION TOOLS

(71) Applicant: John L. Sternick, Brandon, SD (US)

(72) Inventor: John L. Sternick, Brandon, SD (US)

( * ) Notice: Subject to any disclaimer, the term of this patent is extended or adjusted under 35 U.S.C. 154(b) by 0 days.

(21) Appl. No.: 15/914,462

(22) Filed: Mar. 7, 2018

Related U.S. Application Data

(62) Division of application No. 14/959,738, filed on Dec. 4, 2015, now Pat. No. 10,357,767.

(51) Int. Cl.
*B01L 3/18* (2006.01)
*B01L 9/00* (2006.01)

(52) U.S. Cl.
CPC ..... *B01L 3/18* (2013.01); *B01L 9/50* (2013.01); *B01L 2200/025* (2013.01); *B01L 2300/0609* (2013.01)

(58) Field of Classification Search
None
See application file for complete search history.

(56) References Cited

U.S. PATENT DOCUMENTS

| | | | | |
|---|---|---|---|---|
| 781,250 A | | 1/1905 | Welch | |
| 1,410,522 A | * | 3/1922 | Ziemba | A47J 43/1093 416/70 R |
| 3,077,780 A | | 2/1963 | Takatsy | |
| 3,147,197 A | | 9/1964 | Connors | |
| 3,191,813 A | | 6/1965 | Duff | |
| 3,225,639 A | | 12/1965 | Martinelli | |
| 3,455,788 A | | 7/1969 | Curry | |
| 3,498,135 A | | 3/1970 | Seitz | |
| 3,525,264 A | | 8/1970 | Nieglos | |
| 3,875,015 A | | 4/1975 | Wadley | |
| 3,949,471 A | | 4/1976 | Cawley | |
| 4,010,077 A | | 3/1977 | Pardos | |
| 4,030,978 A | | 6/1977 | Abramson | |
| 4,102,748 A | | 7/1978 | Vacanti | |
| D282,278 S | | 1/1986 | Asa | |

(Continued)

FOREIGN PATENT DOCUMENTS

| | | |
|---|---|---|
| CN | 102839114 | 12/2012 |
| DE | 3913882 | 5/1990 |

(Continued)

OTHER PUBLICATIONS

English translation of WO 2011/058234. (Year: 2011).*

*Primary Examiner* — Matthew D Krcha
(74) *Attorney, Agent, or Firm* — Jeffrey A. Proehl; Woods, Fuller, Shultz & Smith, PC

(57) ABSTRACT

Sample manipulating tools may comprise a handle portion and a tool portion. A sample spreading tool may comprise a head connected to the handle portion by a pivot connection permitting at least pivotal movement of the tool portion with respect to the handle portion. The head may comprise a perimeter section and a bridge section. Another sample spreading tool may comprise a central element and at least two loop segments connected to the central element with each loop segment having a substantially arcuate shape. A sample picking tool may have a loop section forming a reservoir for receiving a liquid sample and a hook portion fixed to the loop section, with a first end fixed to the loop portion and a second end being a free end. A sample scraping tool may comprise a mounting structure to receive a pipette and a scraper structure having a scraping edge.

13 Claims, 17 Drawing Sheets

(56) References Cited

U.S. PATENT DOCUMENTS

| | | | | |
|---|---|---|---|---|
| 4,581,969 | A | 4/1986 | Kim | |
| 4,687,746 | A * | 8/1987 | Rosenberg | C12M 33/02 422/430 |
| 4,892,831 | A | 1/1990 | Wong | |
| D313,533 | S * | 1/1991 | Rixen | D7/380 |
| 5,125,544 | A | 6/1992 | Millner | |
| 5,197,949 | A | 3/1993 | Angsupanich | |
| D343,679 | S | 1/1994 | Wong | |
| 5,279,964 | A | 1/1994 | Chrisope | |
| 5,643,217 | A | 7/1997 | Dobkin | |
| 5,740,708 | A | 4/1998 | Tabone | |
| 5,865,081 | A | 2/1999 | Myers | |
| 6,194,199 | B1 | 2/2001 | Asa | |
| 6,245,558 | B1 | 6/2001 | Rappin | |
| 6,521,190 | B1 | 2/2003 | Edens | |
| 6,575,989 | B1 | 6/2003 | Scheller | |
| 7,247,275 | B2 | 7/2007 | Caldwell | |
| 7,540,844 | B2 | 6/2009 | Muser | |
| 7,863,034 | B2 | 1/2011 | Welch | |
| 9,005,543 | B2 | 4/2015 | Asa | |
| 2004/0248237 | A1 | 12/2004 | Petit | |
| 2006/0051735 | A1 * | 3/2006 | Fuhr | B01L 3/021 435/4 |
| 2008/0038155 | A1 * | 2/2008 | Chian | A61D 19/024 422/400 |
| 2012/0142052 | A1 | 6/2012 | Kohlschovsky | |
| 2013/0017568 | A1 | 1/2013 | Enriquez | |
| 2013/0019725 | A1 | 1/2013 | Magavi | |

FOREIGN PATENT DOCUMENTS

| | | | |
|---|---|---|---|
| EP | 0152368 | 1/1988 | |
| WO | WO-2011058234 A1 * | 5/2011 | A47J 43/1093 |

* cited by examiner

SAMPLE MANIPULATION TOOLS

BACKGROUND

Field

The present disclosure relates to laboratory tools and more particularly pertains to new sample manipulation tools for moving, spreading, picking, and otherwise manipulating samples in an easier manner than is possible with conventional tools.

SUMMARY

In one aspect, the present disclosure relates to a sample spreading tool comprising a handle portion being elongated with a first end and a second end, and a tool portion at the second end of the handle portion and having an inboard end and an outboard end with the inboard end being connected to the second end of the handle portion. The tool portion may comprise a head connected to the handle portion by a pivot connection permitting at least pivotal movement of the tool portion with respect to the handle portion. The head may comprise a perimeter section having a lower surface lying substantially in a plane, and the perimeter section may surround a central opening. The head may also comprise a bridge section extending between opposite locations on the perimeter section, with the bridge section being offset from the plane of the lower surface.

In another aspect, the present disclosure relates to a sample spreading tool comprising a handle portion being elongated with a first end and a second end, and a tool portion at the second end of the handle portion and having an inboard end and an outboard end with the inboard end being connected to the second end of the handle portion. The tool portion may comprise a central element extending from the inboard end to the outboard end of the tool portion, and at least two loop segments connected to the central element. Each of the loop segments may have an inner end connected to the central element at the inboard end of the tool portion and an outer end connected to central element at the outboard end of the tool portion. Each of the loop segments may have a substantially arcuate shape between the inner and outer ends.

In a further aspect, the present disclosure relates to a sample picking tool comprising a handle portion being elongated with a first end and a second end, and a tool portion at the second end of the handle portion and having an inboard end and an outboard end with the inboard end being connected to the second end of the handle portion. The tool portion may comprise a loop section forming a reservoir for receiving a liquid sample, with the loop section being located at the inboard end of the tool portion and fixed to the handle portion. The tool portion may also comprise a hook portion fixed to the loop section, with a first end fixed to the loop portion and a second end being a free end.

In yet another aspect, the present disclosures relates to a sample scraping tool for mounting on a pipette having a tip with a hole into a hollow interior of the pipette, with the pipette also having an exterior surface with a portion that tapers narrower toward the tip. The tool may comprise a mounting structure configured to receive a portion of the pipette to mount the mounting structure on the exterior surface of the pipette. The mounting structure may be tubular with opposite openings including a tip opening through which the tip of the pipette is able to protrude and a back opening through which a major portion of the pipette extends when the mounting structure is mounted on the pipette. The tool may also comprise a scraper structure having a scraping edge for scraping a surface, and a connection structure connecting the scraper structure to the mounting structure in a manner permitting movement of the scraper structure with respect to the mounting structure and a pipette on which the mounting structure is mounted.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
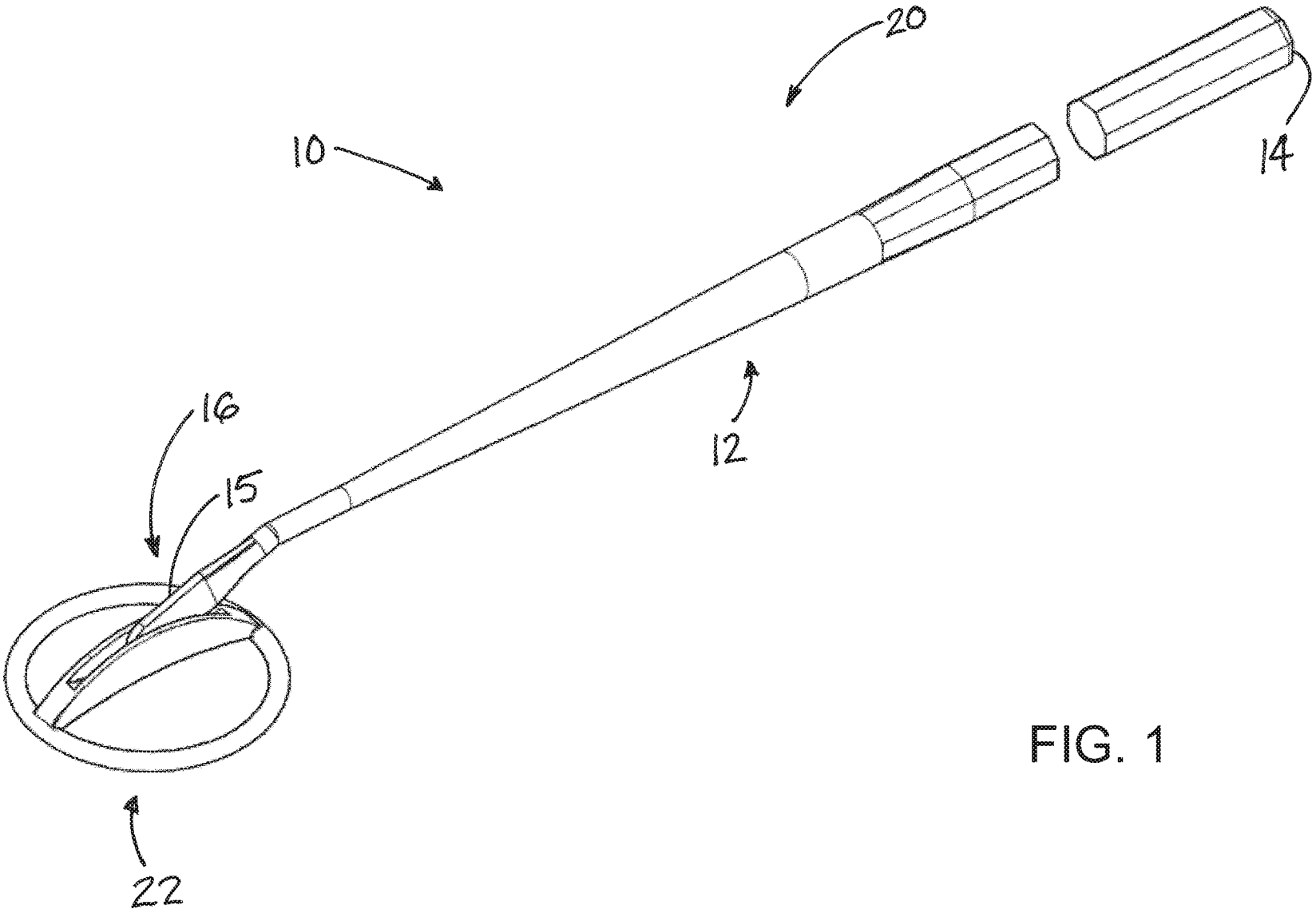
FIG. 1 is a schematic perspective view of a new sample spreading tool according to the present disclosure.
Figure 3:
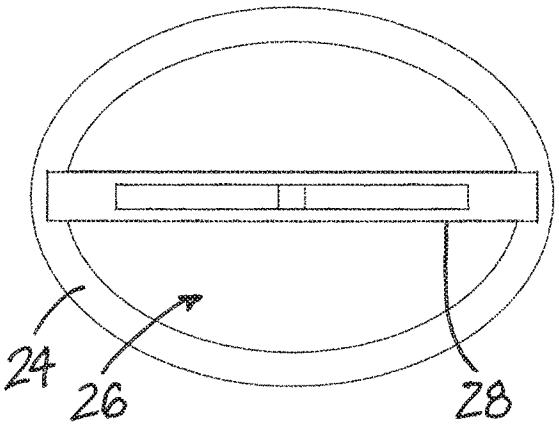
FIG. 3 is a schematic top view of another embodiment of the head of the tool portion of the tool of FIG. 1, according to an illustrative embodiment.
Figure 5:
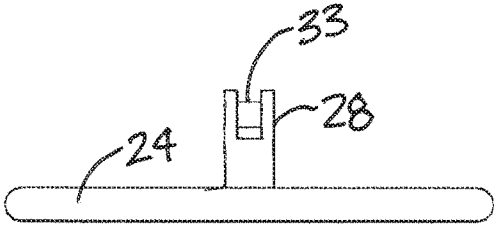
FIG. 5 is a schematic side view of the head of the tool portion, according to an illustrative embodiment.
Figure 2:
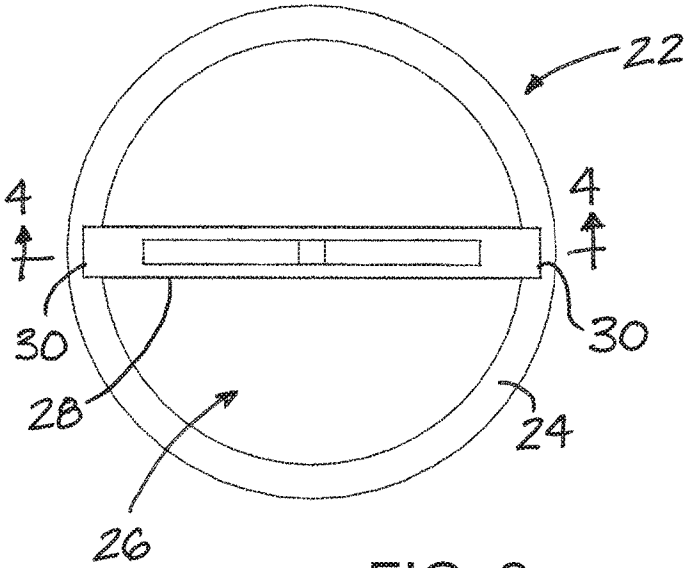
FIG. 2 is a schematic top view of one embodiment of the head of the tool portion of the tool of FIG. 1, according to an illustrative embodiment.
Figure 4:
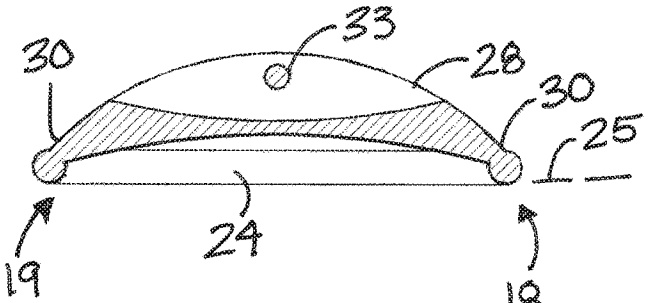
FIG. 4 is a schematic sectional view of the embodiment of the head of the tool portion of FIG. 2 taken along line 4-4, according to an illustrative embodiment.
Figure 7:
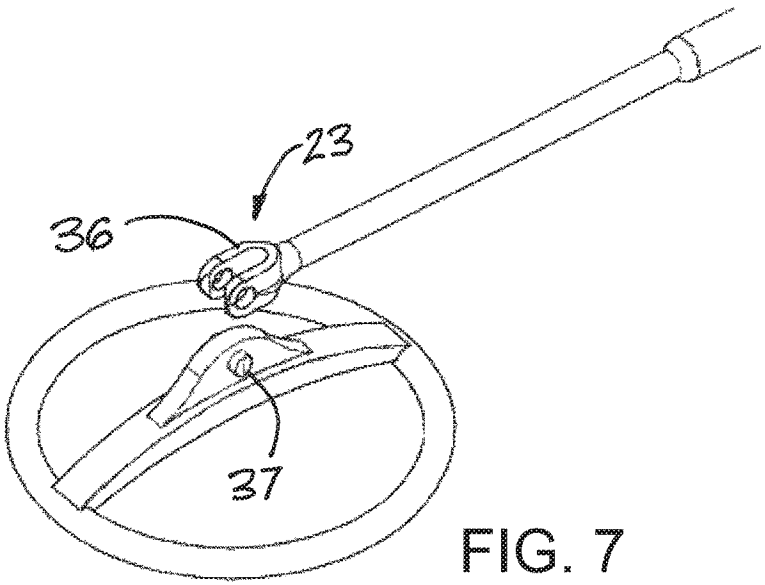
FIG. 7 is a schematic perspective view of the sample spreading tool in an exploded condition to show detail of another embodiment of the pivot connection, according to an illustrative embodiment.
Figure 6:
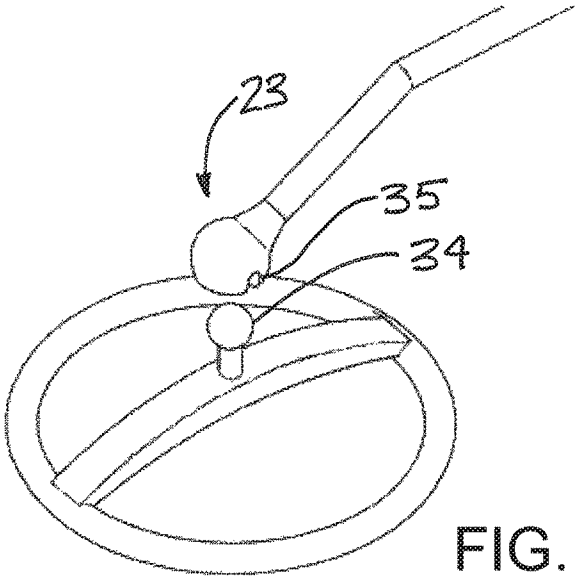
FIG. 6 is a schematic perspective view of the sample spreading tool in an exploded condition to show detail of another embodiment of the swivel connection, according to an illustrative embodiment.
Figure 8:
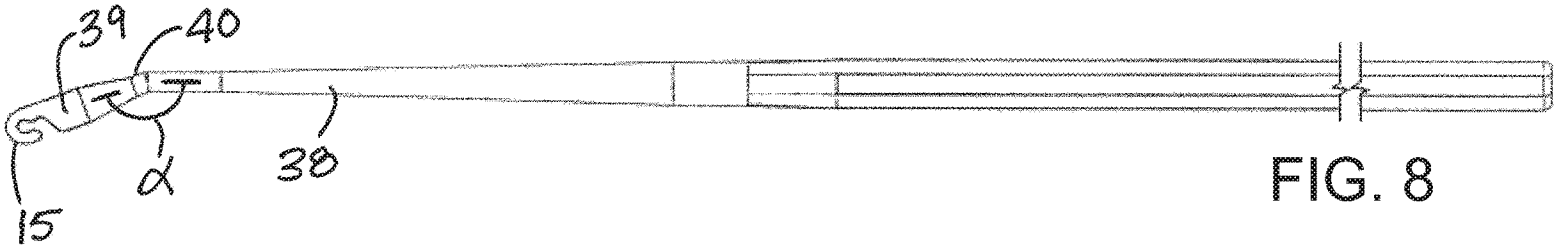
FIG. 8 is a schematic side view of the handle portion of the sample spreading tool, according to an illustrative embodiment.
Figure 9:
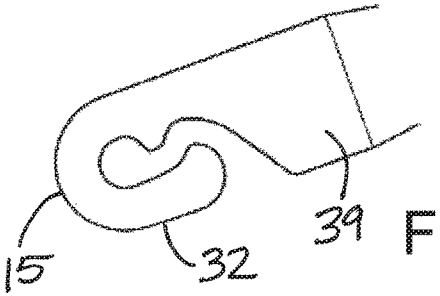
FIG. 9 is a schematic side view of a fragment of the handle portion of the sample spreading tool, according to an illustrative embodiment.
Figures 10, 11:
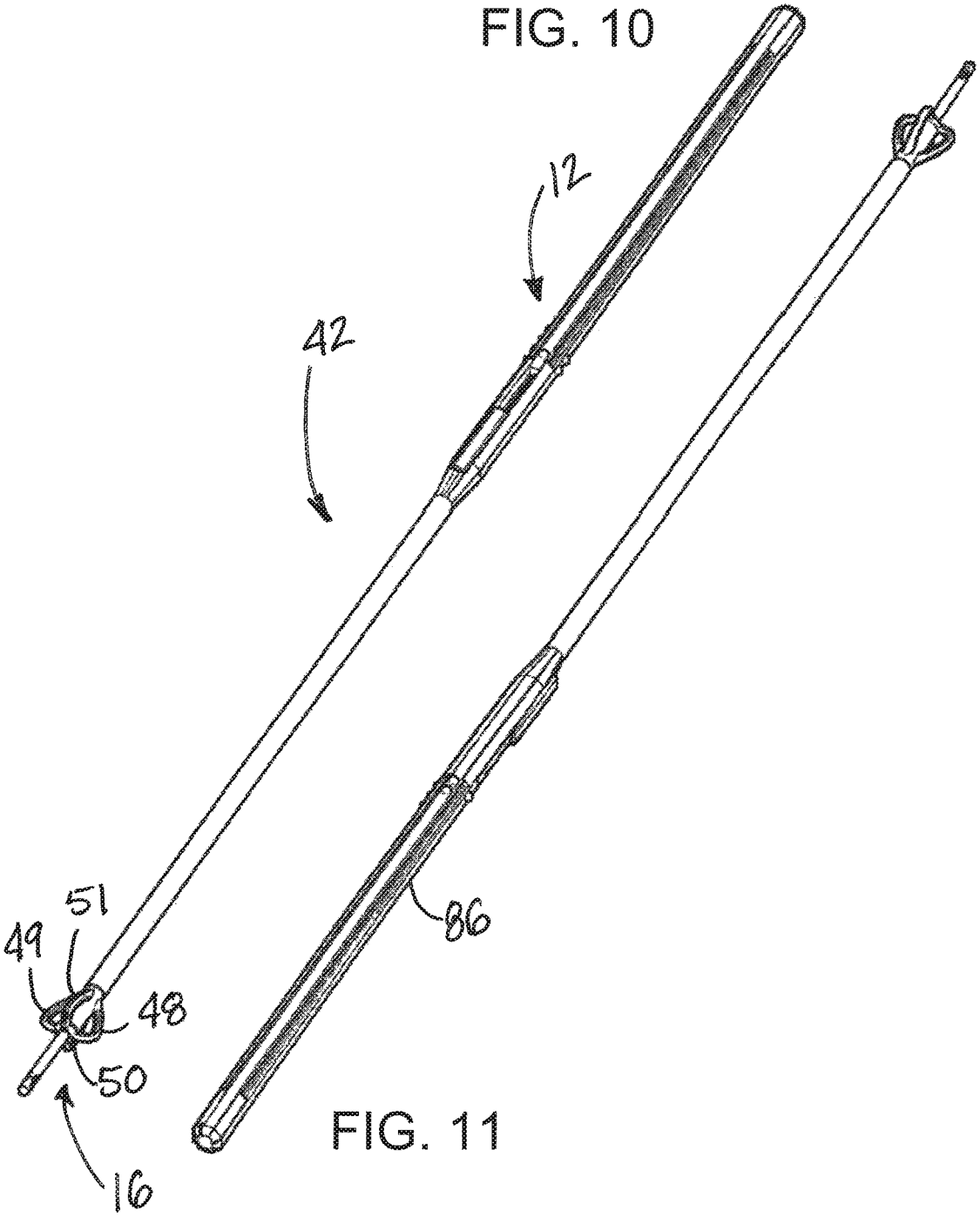
FIG. 10 is a schematic perspective view of a new finned sample spreading tool according to the present disclosure.
FIG. 11 is a schematic perspective view of the finned sample spreading tool of FIG. 10, according to an illustrative embodiment.
Figure 12:
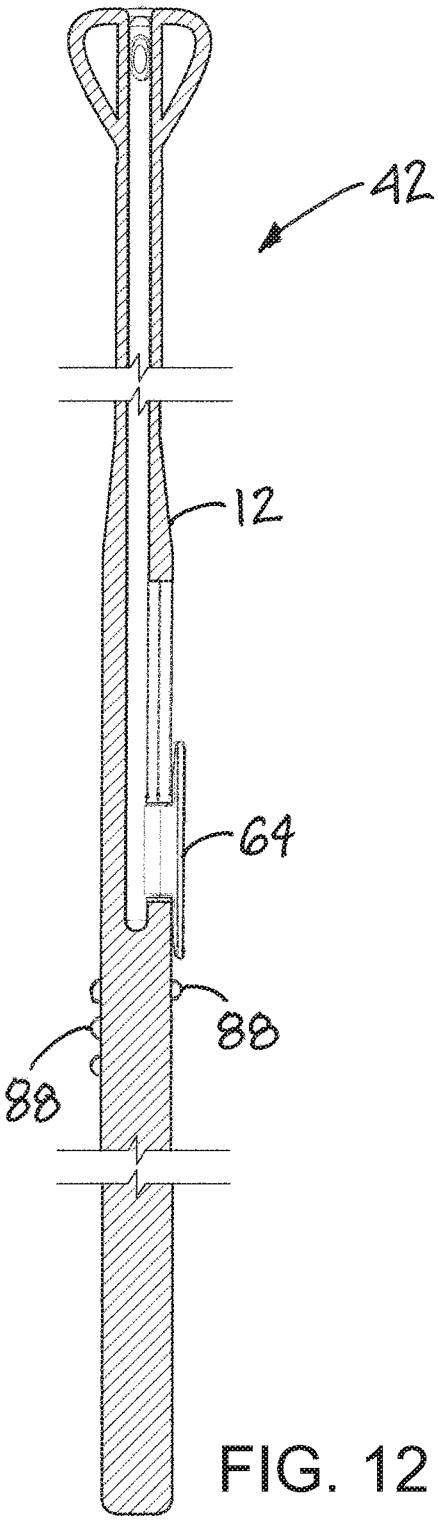
FIG. 12 is a schematic sectional side view of the finned sample spreading tool with the sample needle in the retracted condition, according to an illustrative embodiment.
Figure 13:
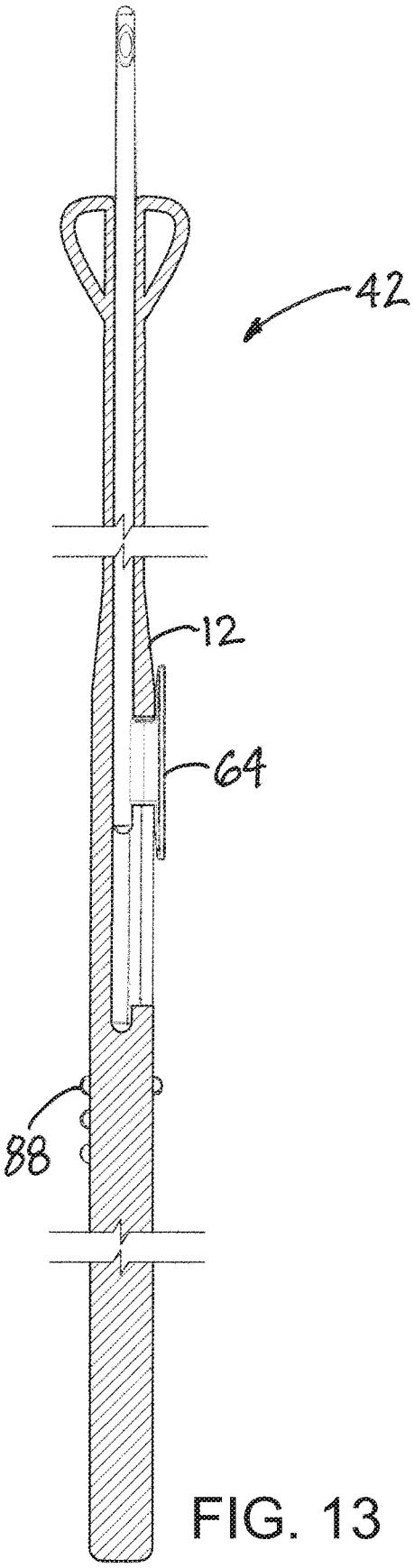
FIG. 13 is a schematic sectional side view of the finned sample spreading tool with the sample needle in the extended condition, according to an illustrative embodiment.
Figure 15:
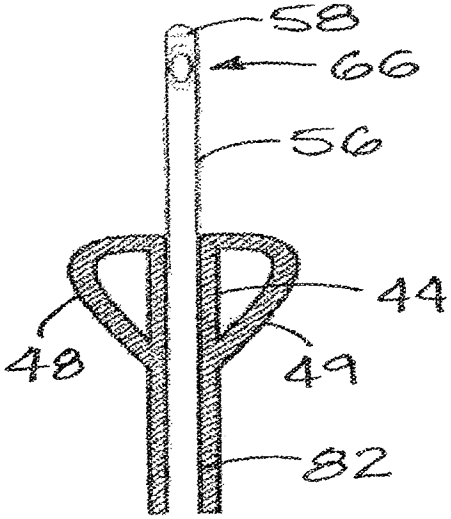
FIG. 15 is a schematic sectional view of a fragment of the finned sample spreading tool with the sample needle in the extended condition, according to an illustrative embodiment.
Figure 14:
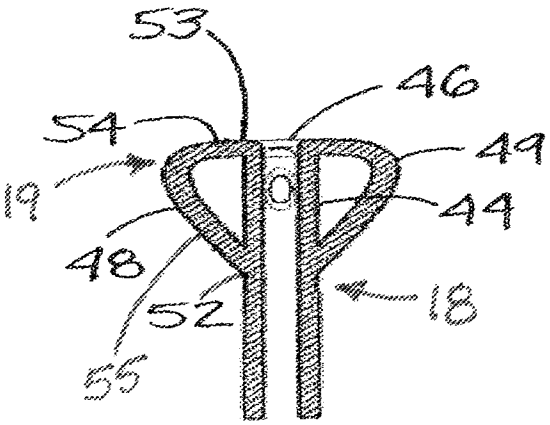
FIG. 14 is a schematic sectional view of a fragment of the finned sample spreading tool with the sample needle in the retracted condition, according to an illustrative embodiment.
Figure 20:
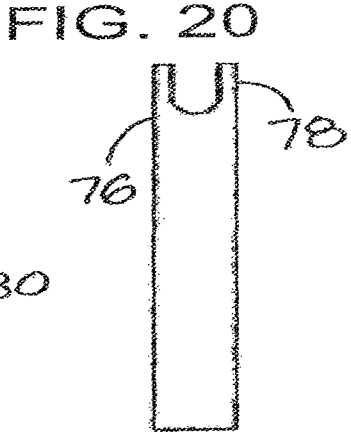
FIG. 20 is a schematic side view of another embodiment of a portion of the sample needle in the extended condition, according to an illustrative embodiment.
Figure 19:
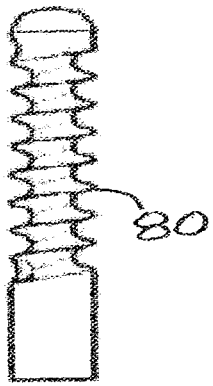
FIG. 19 is a schematic side view of another embodiment of a portion of the sample needle in the extended condition, according to an illustrative embodiment.

With reference now to the drawings, and in particular to FIGS. 1 through 42 thereof, a new sample manipulation tools embodying the principles and concepts of the disclosed subject matter will be described.

In various aspects, the disclosure relates to embodiments of sample manipulation tools 10 which may be useful for manipulating a sample in a laboratory or other controlled environment which may include the interior of a container such as a Petri dish or plate with a layer of gelatinous material, such as a nutrient agar. The tools may be useful for manipulating at least a portion of the sample, such as by spreading, lifting, transporting, gathering, or even separating the sample from the underlying surface, as well as other useful actions.

The sample manipulation tools 10 may include a handle portion 12 for gripping by the hand of the user during use of the tool, and which may be elongated with a first end 14 and a second end 15. The first end 14 may generally be a free end for positioning towards the hand or forearm of the user, and the second end 15 may generally be a tool end where a tool or other manipulation element is located. In some embodiments, the handle portion 12 may have a substantially circular cross-sectional exterior shape, although as will be described elsewhere in this disclosure, other cross sectional shapes may be used to particular advantage. The sample manipulation tool 10 may also include a tool portion 16 which may be located at the second end 15 of the handle portion. The tool portion 16 may be at least partially integrally formed with the handle portion, although some tools may have elements that are separate or separable from the handle portion. The tool portion may be elongated to some degree with an inboard end 18 which may be connected to the second end 15 of the handle portion, and an outboard end 19 located generally opposite of the inboard end on the tool portion. Typically, although not necessarily, the outboard end 19 of the tool portion is employed to manipulate a sample.

In some embodiments, such as shown in FIGS. 1 through 9, the sample manipulation tool 10 may comprise a sample spreading tool 20 which is highly useful for spreading a sample, such as a cell colony, over the surface of a nutrient agar. In such embodiments, the tool portion 16 may comprise a head 22 connected to the second end of the handle portion by a pivot connection 23 which permits at least pivotal movement of the tool portion 16 with respect to the handle portion, and in some embodiments may permit swivel movement of the tool portion relative to the handle portion. The head 22 may have a perimeter section 24 which may have a lower surface that substantially lies in a plane 25 such that most or all of the perimeter section is able to effectively contact a planar surface, such as, for example, the upper surface of a layer of agar in a dish, for example. The perimeter section 24 may be continuous, and may surround a central opening 26. In some embodiments, the perimeter section may be substantially circular in shape (see, e.g., FIG. 2), and in some embodiments the perimeter section may be oval in shape (see, e.g., FIG. 3). Optionally, but less advantageously, the perimeter section 24 may have a polygonal shape.

The tool portion 16 of the sample spreading tool 20 may also include a bridge section 28 which may extend between opposite locations on the perimeter section 24. The bridge section may be elongated with opposite ends 30, and each of the opposite ends may be connected to the opposite locations of the perimeter section. The bridge section 28 may be offset or raised from the plane 25 of the perimeter section 24, such as by being bowed or arched in shape, such that it is unlikely to come into contact with a planar surface that is engaged by the perimeter section 24.

In some embodiments, the pivot connection 23 may comprise a hook 32 and a bar 33 (see FIGS. 4, 5, 8, and 9) which may be releaseably engaged with each other to permit pivot movement therebetween. The hook 32 may be formed on the first end 14 of the handle portion and the bar 33 may be formed on the bridge section 28 of the head 22. The bar 33 may extend along a line that is oriented substantially parallel to the plane of the perimeter section 24. The hook 32 may be engaged with the bar 33 such that the handle portion 12 pivots with respect to the tool portion 16. In other embodiments, the pivot connection 23 may comprise a ball 34 and a socket 35 (see FIG. 6) with the ball 34 being at least pivotably, and optionally swivelly, received in the socket 35. The ball 34 may be formed on the handle portion at the second end 15, and the socket 35 may be formed on the bridge section 28 of the head 22. In other embodiments, the pivot connection 23 may comprise a clevis bracket 36 and an aperture 37 (see FIG. 7), with the clevis bracket being pinned by a pin to the aperture. Illustratively, the clevis bracket may be formed on the second end 15 of the handle portion, and the aperture may be formed on the bridge section 28 of the head 22. It should be recognized that the positioning of the elements of the pivot connection 23 on the handle 12 and tool 16 portions may be reversed.

In some embodiments, the handle portion 12 of the sample spreading tool 20 may be substantially linear in shape, and in some embodiments the handle portion may have a primary section 38 and a secondary section 39, with the primary section extending from the first end 14 of the handle portion to a juncture 40, and the secondary section may extend from the juncture 40 to the second end 15. The primary 38 and secondary 39 sections may each have a longitudinal axis, and in some embodiments the longitudinal axis of the primary section and the longitudinal axis of the secondary section may be angled with respect to each other such that the longitudinal axes are oriented at an angle $\alpha$ (see FIG. 8) with respect to each other to produce a bend in the handle portion at the juncture 40. Illustratively, the angle alpha may measure from approximately 140 degrees to approximately 179 degrees.

The loop formed by the perimeter section of the head 22 may extend outwardly in all directions from the point of connection of the handle portion to the tool portion which may permit the perimeter section to more easily reach to the edges of the interior of the dish, and the continuous nature of the perimeter section loop may spread sample material more effectively over the surface of agar in a dish. The bend in the handle portion 12 may assist in reaching the tool over the upper edge of the perimeter wall of the Petri dish as the sample is spread over the surface of the agar, and particularly in combination with the loop of the perimeter section, reaching virtually all portions of the agar surface becomes easier. Advantageously, as the cover for the Petri dish is held in close proximity to the upper opening of the dish and a sample is spread over the upper surface of the agar, the head portion is able to reach more areas of the agar surface without having to rotate the Petri dish in the users hands, and opening and reclosing the top each time the dish is rotated. Rapid and even distribution of bacterial or other cell cultures in a Petri or other culture dish is enabled. Minimal manipulation of the Petri dish and spreader tool by the user increases the speed of spreading samples without gouging the surface of the nutrient agar.

When a drop of the sample is placed on the surface of the nutrient agar in the Petri plate, the spreading tool 20 may be positioned on top of the drop and swept in a gliding motion from side to side, spreading the sample from edge to edge of the Petri plate without moving the plate. The pivot connection between the handle portion and the tool portion may permit a change in the angle of the handle portion with respect to the Petri plate without removing the perimeter section from contact with the agar surface. Further, the rounded nature of the tool portion minimizes the opportunity to gouge or cut into the surface of the agar.

In other embodiments, such as shown in FIGS. 10 through 26, the sample manipulation tool 10 may comprise a finned sample spreading tool 42. In such embodiments, the tool portion 16 may include a central element 44 which may extend from the inboard end 18 of the tool portion toward the outboard end 19 of the tool portion. The central element 44 may have a passage 46 therein, and the passage may extend from the inboard end 18 to the outboard end 19.

The tool portion of the sample spreading tool 42 may also include at least two loop segments 48, 49 which are connected to the central element 44, and in some illustrative embodiments the tool portion includes four loop segments 48, 49, 50, and 51. The four loop segments may effectively form two complete loops with the loops being oriented in substantially perpendicular planes with respect to each other.

Each of the loop segments may have an inner end 52 connected to the central element at the inboard end of the tool portion and an outer end 53 connected to the central element at the outboard end of the tool portion. The loop segments may be arcuate in shape between the inner 52 and outer 53 ends, and in some embodiments the loop segments may have outer sections 54 that are positioned in a plane that is oriented substantially perpendicular to the longitudinal axis of the handle portion such that the outer sections of the loop segments are almost linear in that plane, and may be oriented at substantially a 90 degree angle with respect to the longitudinal axis of the handle portion. This configuration of the loop segments may maximize the portion of the loop segment that can be brought into contact with the surface of the agar. The most preferred embodiments minimize the distance from the outboard end 19 of the tool to the location of maximum diameter (or width) of the loop segments of the tool so that the surface of one loop segment can touch the surface without surfaces of the other segments contacting the agar surface. The maximum width of the loop segments should be small enough to facilitate contacting the agar surface close to the sides of the Petri dish. Illustratively, an inner section 55 of the loop segment which is located adjacent to the inner end 52 may be oriented at an oblique angle with respect to the longitudinal axis of the handle portion. In embodiments, such as shown in FIGS. 12 through 15, the intersections 55 may be substantially linear along a divergent axis, and the divergent axis may be oriented at an oblique angle with respect to the central longitudinal axis of the tool portion.

The finned sample spreading tool 42 may include a sample needle 56 which is retractably mounted on the tool portion. The sample needle 56 may be movable between an extended condition (see FIGS. 12 and 14) in which a portion of the sample needle extends from the central element 44, and a retracted condition (see FIGS. 13 and 15) in which the sample needle is retracted into the central element. The sample needle 56 may also extend into the handle portion 12 of the tool 42. The sample needle may be elongated with a tip end 58 that is exposed when the needle is in the extended condition and substantially covered when the needle is in the retracted condition. The needle 56 may also have an interior end 60 situated in the interior of the handle portion.

In some embodiments, the sample needle 56 may include a sample pickup facilitating structure 66 that is formed on the sample needle. The facilitating structure 66 may be located toward the tip end 58 and may have a variety of different configurations (see FIGS. 16 through 20). In some embodiments, such as in FIG. 16, a cup 68 is formed by a recess 70 that extends into the sample needle 56 for cupping a portion of a sample. The recess 70 may extend along an axis that is oriented substantially perpendicular to the longitudinal axis of the sample needle. In other embodiments, the facilitating structure 66 may include a loop 72 formed by an aperture 74 (see FIG. 17) that extends through the sample needle for holding a liquid sample by virtue of surface tension. The aperture 74 may extend along an axis that is also oriented substantially perpendicular to the longitudinal axis of the sample needle.

Figure 18:
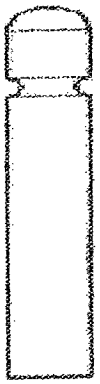
FIG. 18 is a schematic side view of another embodiment of a portion of the sample needle in the extended condition, according to an illustrative embodiment.
Figure 17:
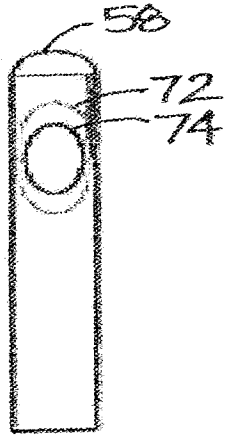
FIG. 17 is a schematic side view of another embodiment of a portion of the sample needle in the extended condition, according to an illustrative embodiment.
Figure 16:
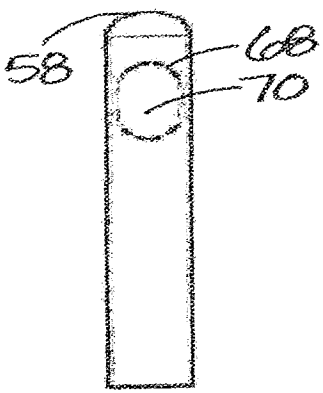
FIG. 16 is a schematic side view of an embodiment of a portion of the sample needle in the extended condition, according to an illustrative embodiment.
Figure 21:
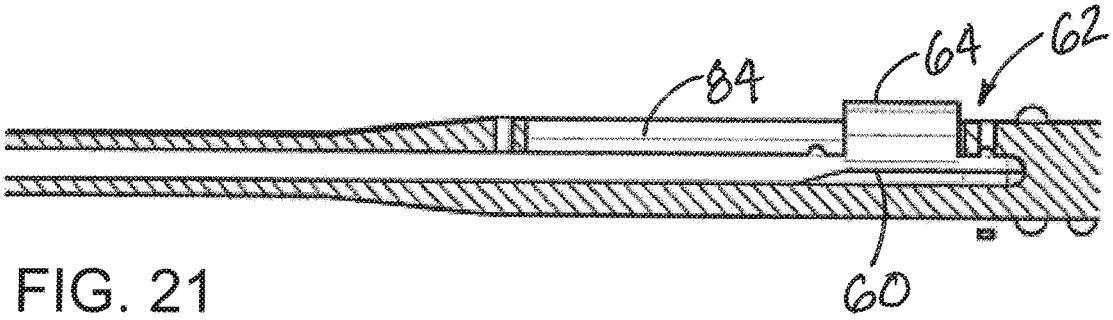
FIG. 21 is a schematic side sectional view of an embodiment of a tool of the disclosure with an actuation handle for the sample needle shown in the retracted position, and illustrating one exemplary lock structure.
Figure 22:
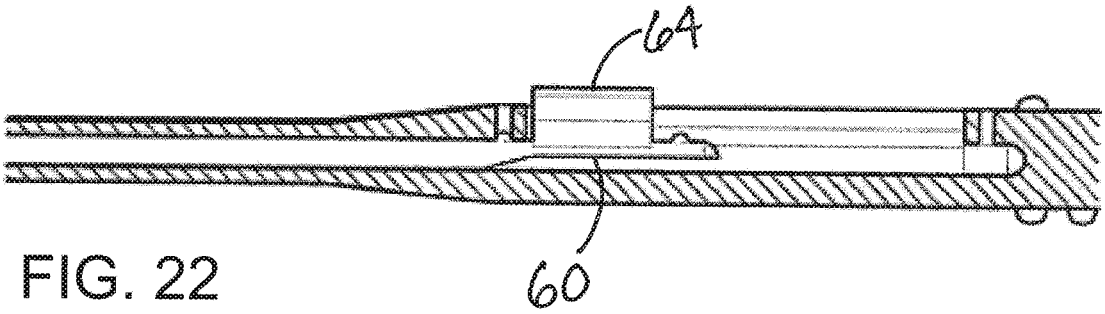
FIG. 22 is a schematic side sectional view of an embodiment of a tool of the disclosure with an actuation handle for the sample needle shown in the extended position with the lock structure of FIG. 21.
Figure 23:
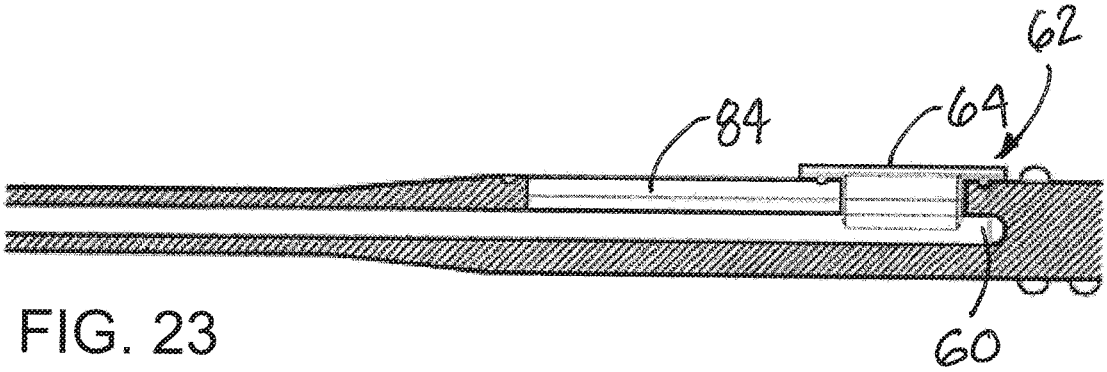
FIG. 23 is a schematic side sectional view of another embodiment of a tool of the disclosure with an actuation handle for the sample needle shown in the retracted position, and illustrating another exemplary lock structure.
Figure 24:
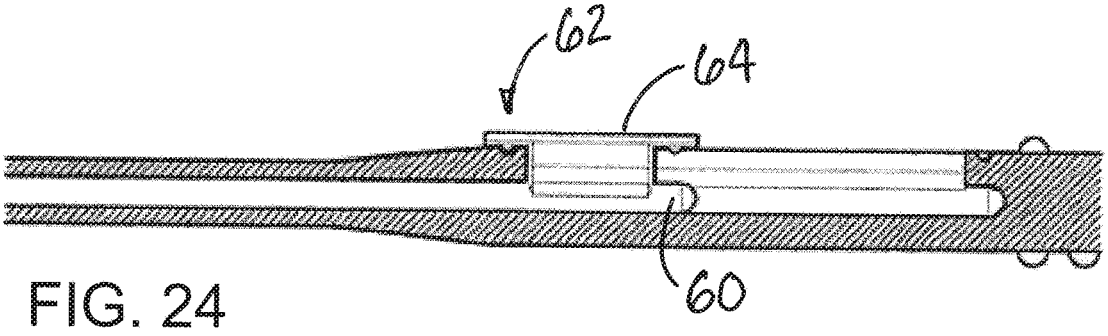
FIG. 24 is a schematic side sectional view of an embodiment of a tool of the disclosure with an actuation handle for the sample needle shown in the extended position with the lock structure of FIG. 23.
Figure 25:
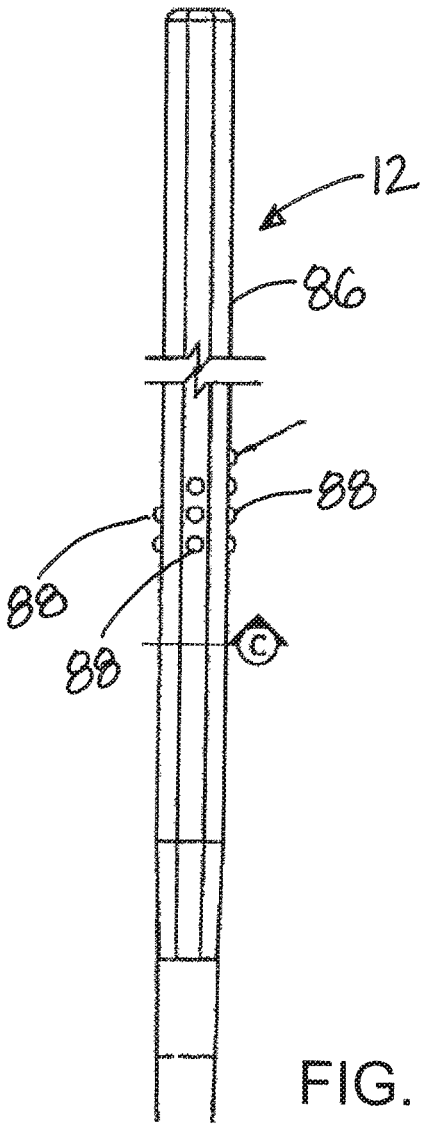
FIG. 25 is a schematic side view of a handle portion of an embodiment of a tool of the disclosure with tactile indicator elements on the handle portion.
Figure 26:
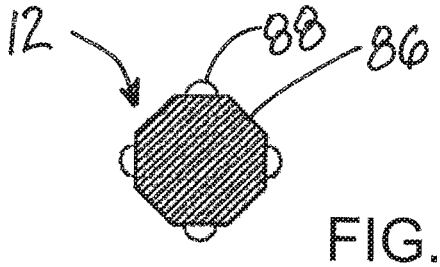
FIG. 26 is a schematic sectional view of a handle portion of an embodiment of a tool of the disclosure with tactile indicator elements on the handle portion.
Figure 27:
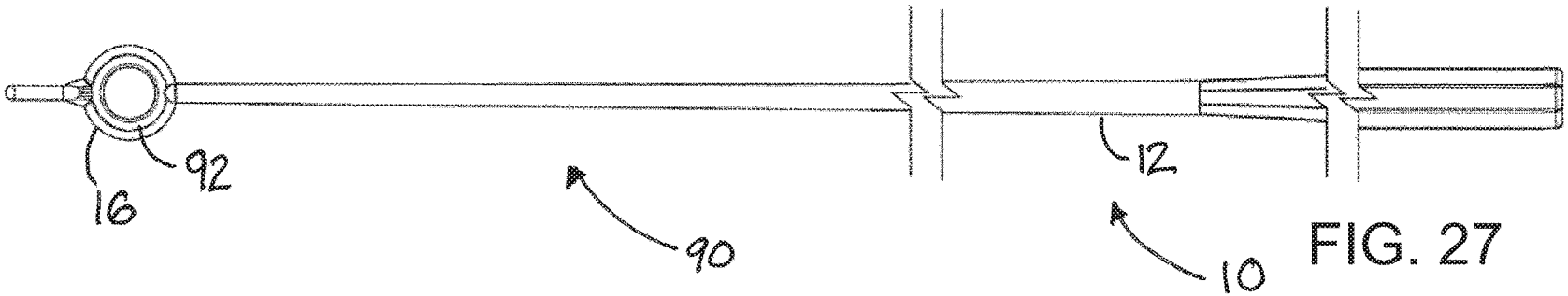
FIG. 27 is a schematic top view of an embodiment of the tool of the disclosure having a loop section and a hook section.
Figure 28:
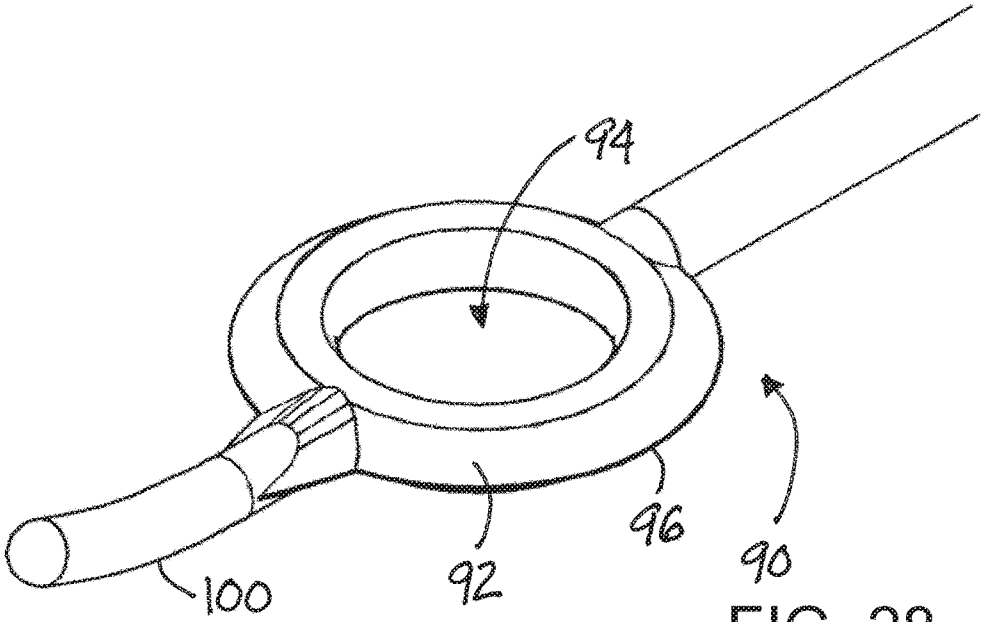
FIG. 28 is a schematic enlarged perspective view of the loop and hook sections of an embodiment of the tool of the disclosure.
Figure 30:
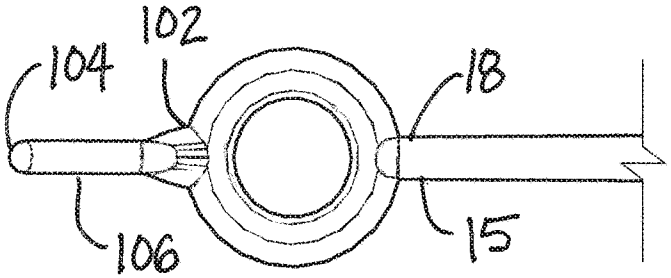
FIG. 30 is a schematic top view of the loop and hook sections of an embodiment of the tool of the disclosure.
Figure 32:
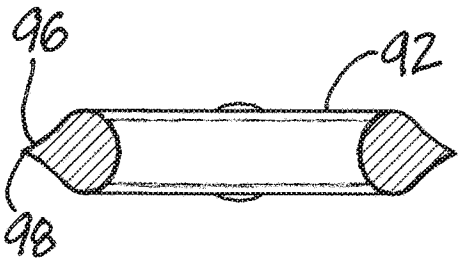
FIG. 32 is a schematic sectional view of the loop section of an embodiment of the tool of the disclosure.
Figure 29:
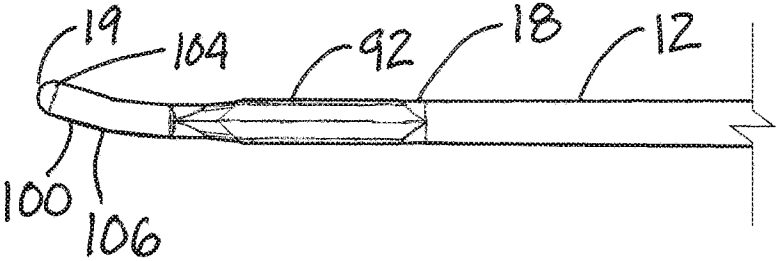
FIG. 29 is a schematic side view of the loop and hook sections of an embodiment of the tool of the disclosure.
Figure 31:
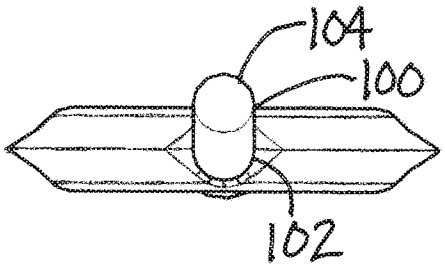
FIG. 31 is a schematic end view of the loop and hook sections of an embodiment of the tool of the disclosure.
Figure 33:
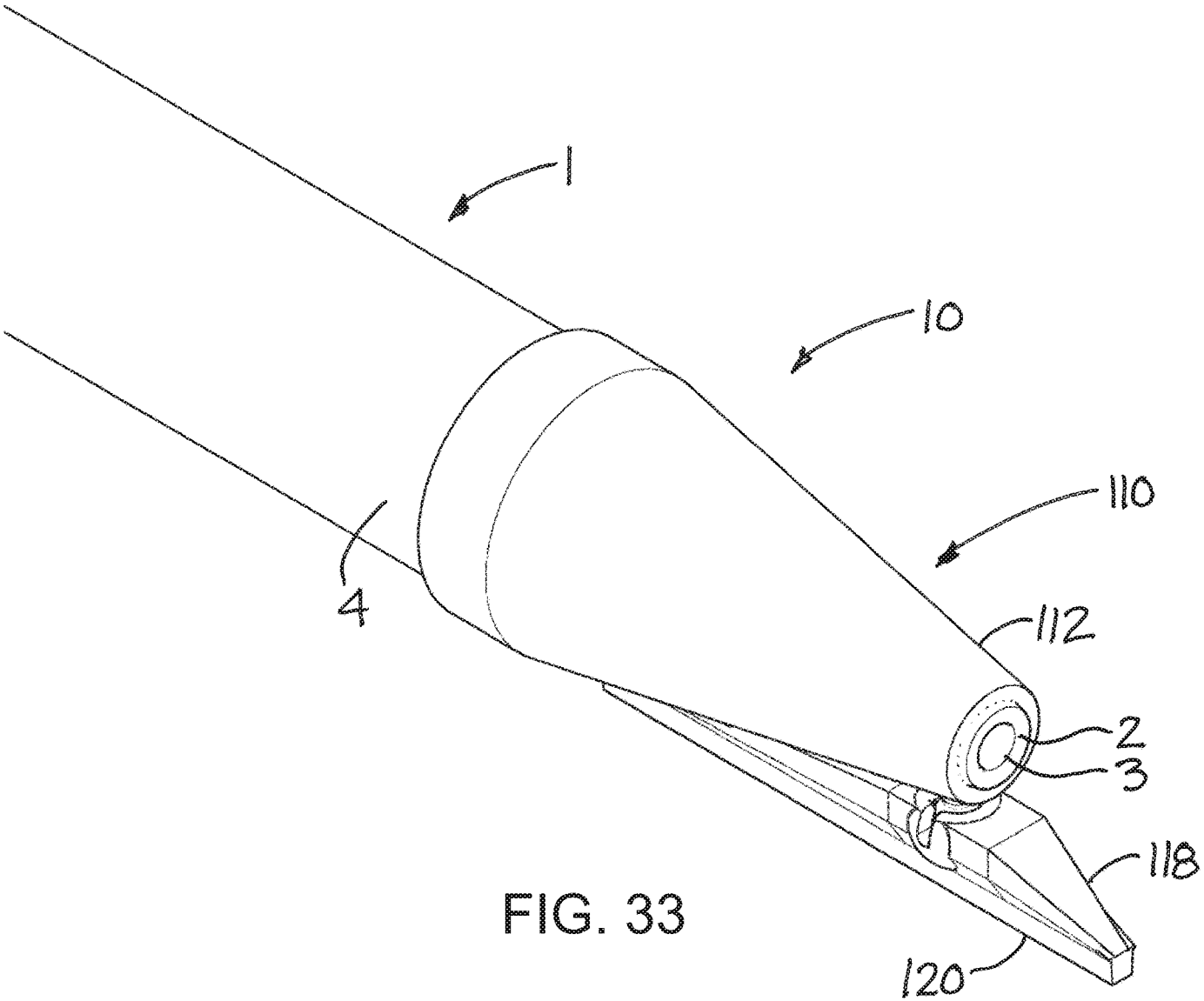
FIG. 33 is a schematic perspective view of an embodiment of a sample scraping tool of the disclosure mounted on a pipette.
Figure 34:
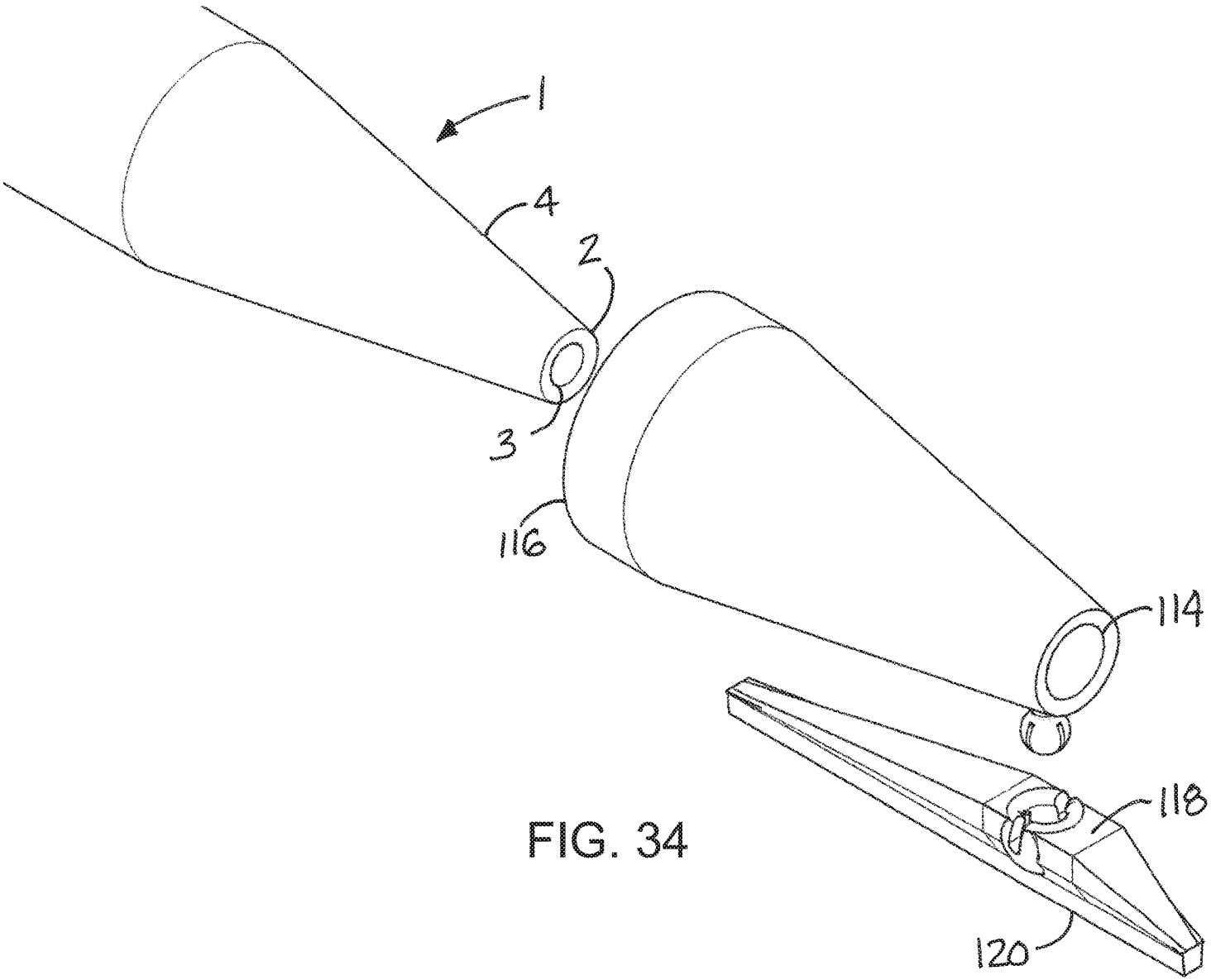
FIG. 34 is a schematic exploded perspective view of an embodiment of the sample scraping tool of the disclosure and a pipette.
Figure 35:
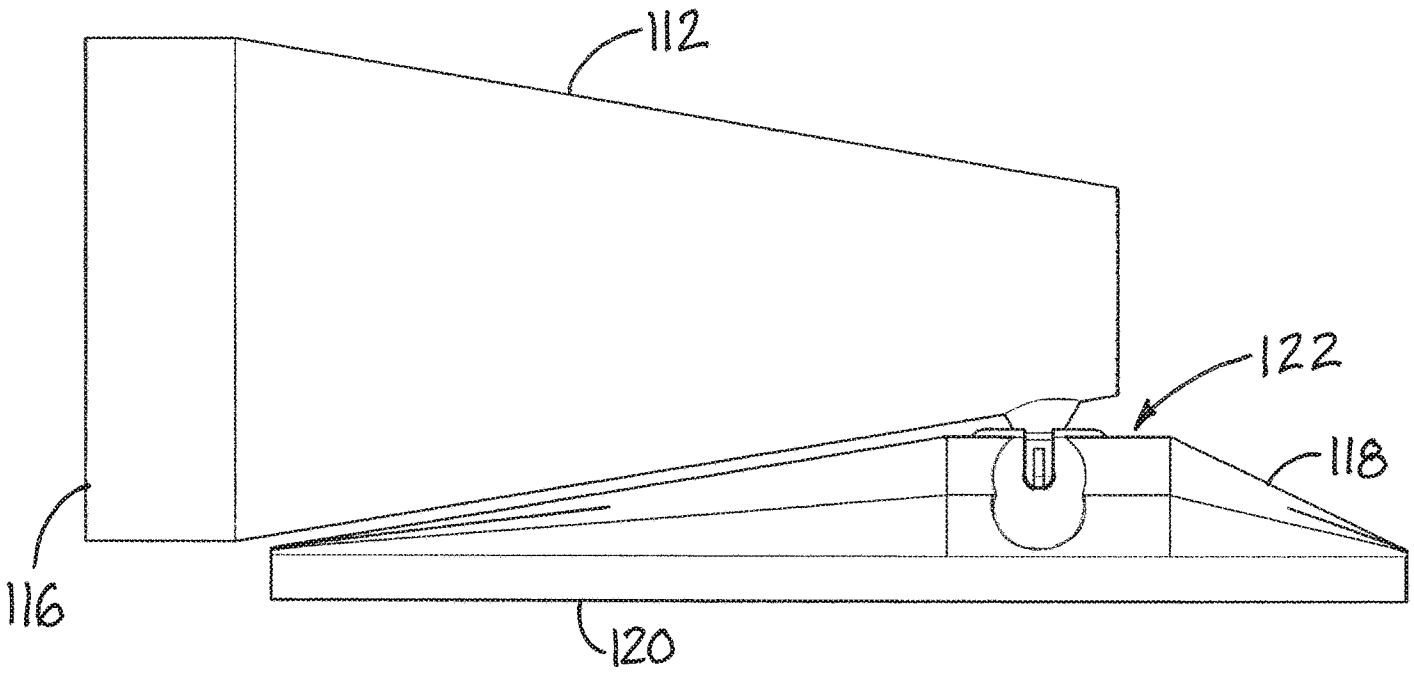
FIG. 35 is a schematic side view of an embodiment of the sample scraping tool of the disclosure.
Figure 37:
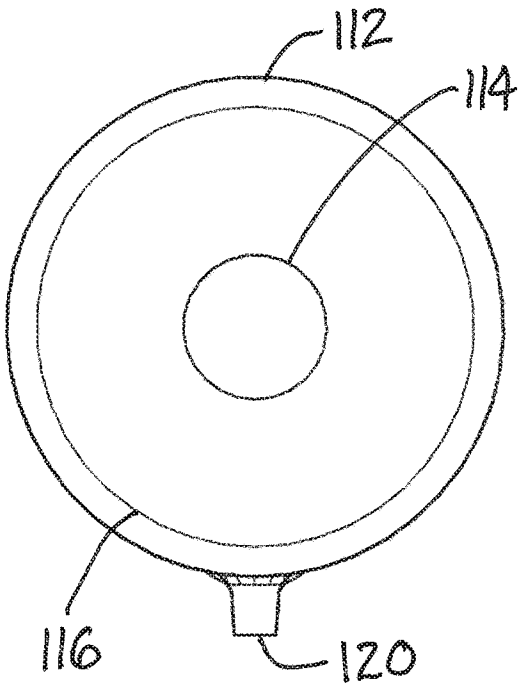
FIG. 37 is a schematic second end view of an embodiment of the sample scraping tool of the disclosure.
Figure 36:
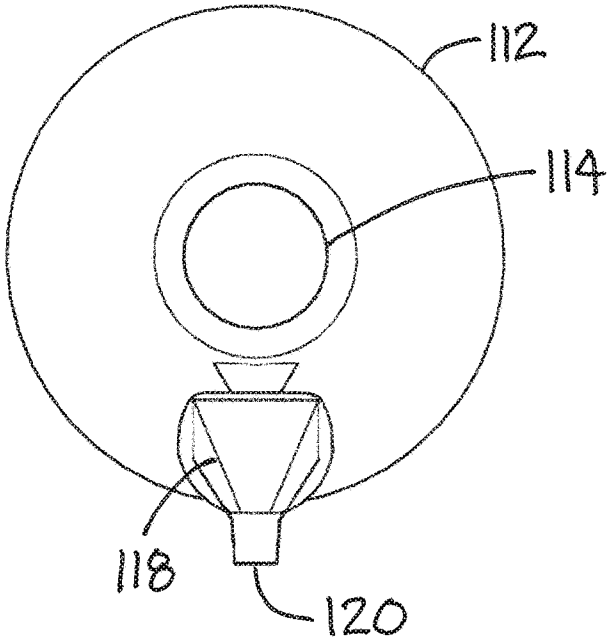
FIG. 36 is a schematic first end view of an embodiment of the sample scraping tool of the disclosure.
Figure 38:
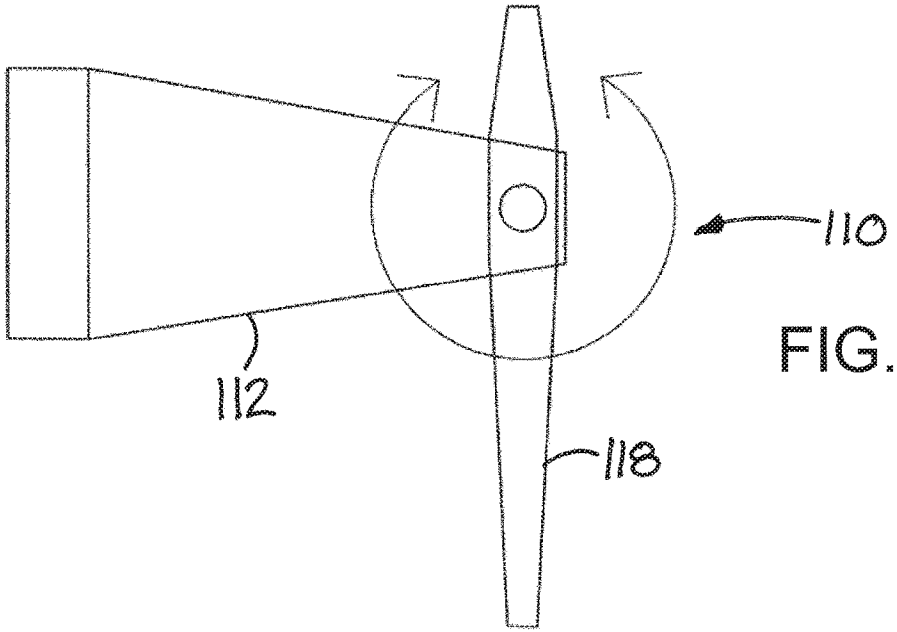
FIG. 38 is a schematic top view of an embodiment of the sample scraping tool of the disclosure with the scraper structure in one position.
Figure 39:
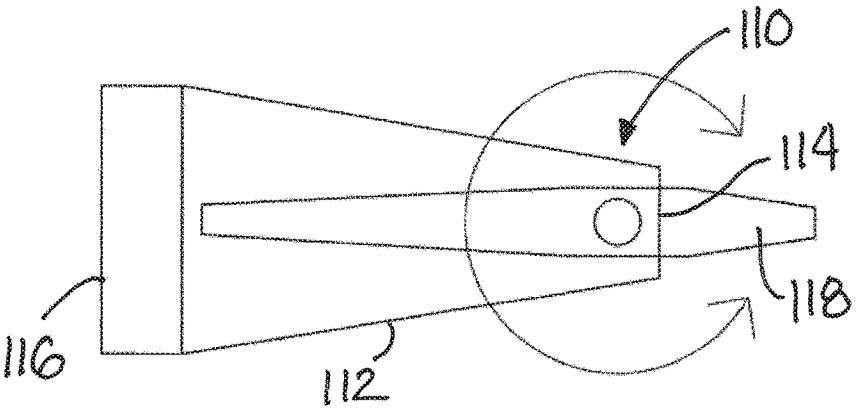
FIG. 39 is a schematic top view of an embodiment of the sample scraping tool of the disclosure with the scraper structure in another position.
Figure 40:
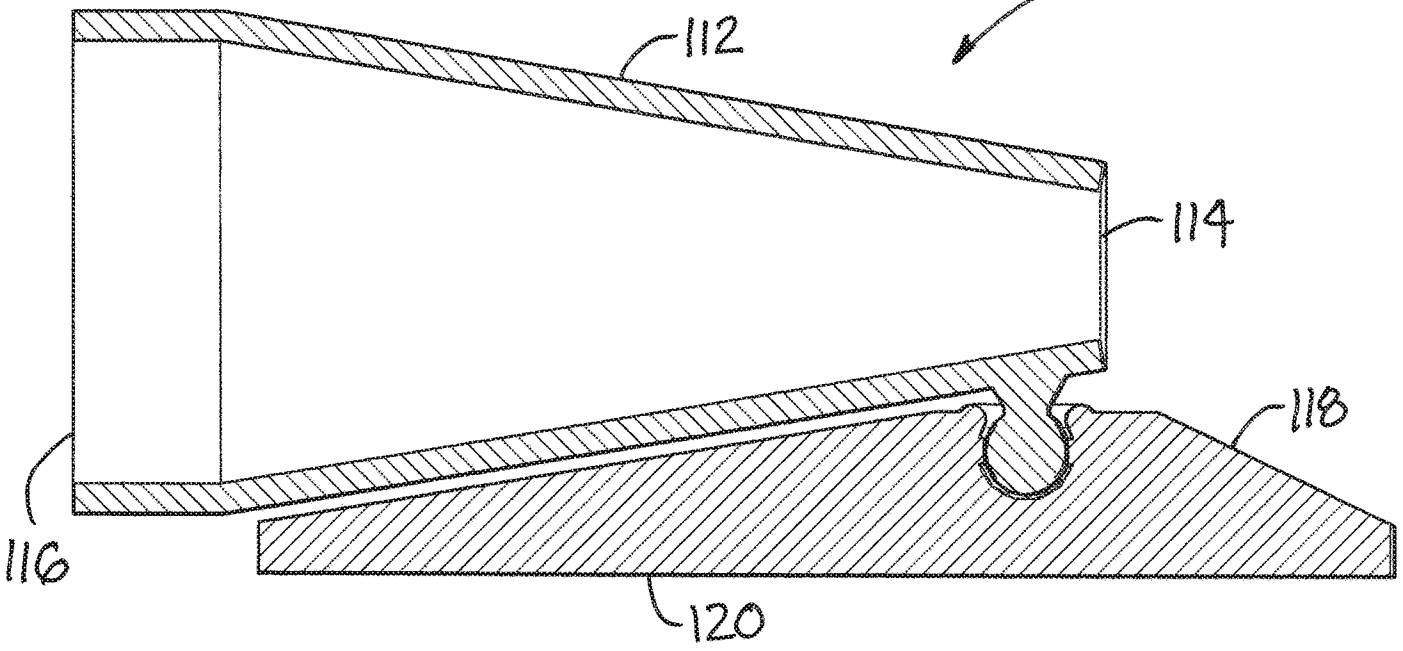
FIG. 40 is a schematic side sectional view of an embodiment of the sample scraping tool of the disclosure.
Figure 41:
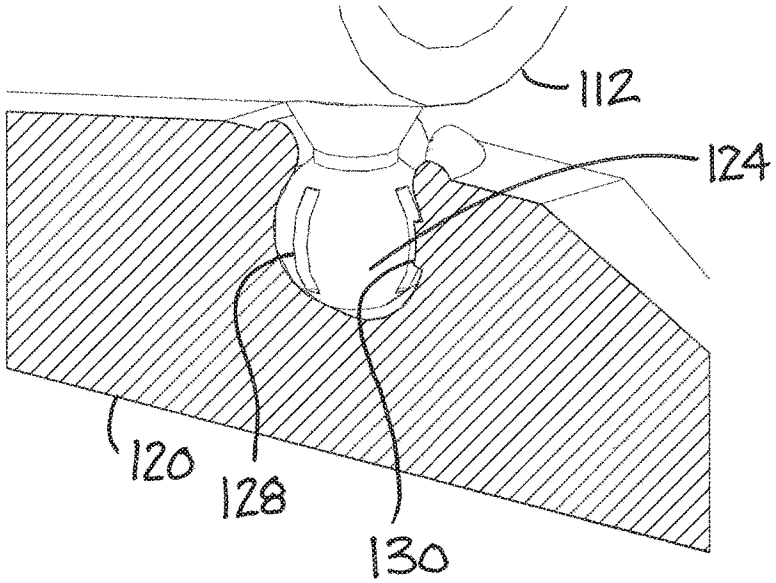
FIG. 41 is a schematic perspective view of an embodiment of the sample scraping tool with a section of the scraper structure to show the relationship between the ball and socket.
Figure 42:
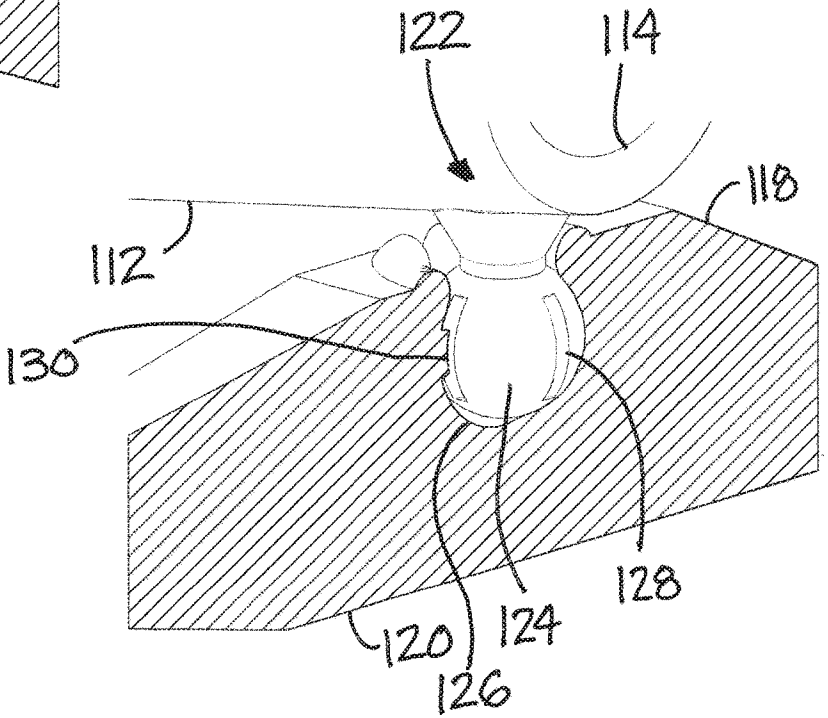
FIG. 42 is a schematic perspective view of an embodiment of the sample scraping tool with a section of the scraper structure to show the relationship between the ball and socket.

In still other embodiments, the facilitating structure 66 may include a fork 76 which is formed on the tip end of the sample needle (see FIG. 18). The fork 76 may have a pair of spaced fork elements 78 which extend substantially parallel to the longitudinal axis of the sample needle for lodging a portion of the sample between the elements. In still other embodiments of the pickup facilitating structure 66, at least one ridge 80 may be formed on an exterior surface of the sample needle. The ridge 80 may extend about the circumference of the needle, and may include a plurality of the ridges that extend about the sample needle. In some embodiments, the plurality of ridges may comprise a plurality of annular ridges, which are separated by grooves extending into the sample needle, while in other embodiments the ridge or ridges may have a helical form such that the ridge and groove forms a thread-like shape.

The handle portion 12 of the tool 42 may have an interior passage 82 that extends for at least a portion of the length of the handle portion and is in communication with the passage of the central element 44 of the tool portion. An access aperture 84 may be formed in the handle portion between the interior passage 88 and an exterior of the handle portion. The actuation handle 64 may be located in the access aperture 84 such that the finger or fingers of the user are able to engage the actuation handle 64 through the access aperture to move the handle 64, and thus the needle, relative to the handle portion.

The sample needle 56 may include a locking structure 62 for releasably holding the sample needle 56 in at least the extended condition with respect to the central element, and may also hold the needle in the retracted condition (see FIGS. 21 through 24). The locking structure 56 may be located on the sample needle toward the interior end 60, and may engage structure on the handle portion 12 to hold the needle in one or both of the conditions of the needle. The actuation handle 64 may form a portion of the locking structure. For example, as shown in FIGS. 21 through 24, the actuation handle 64 may have one or two lugs that may be engaged with recesses or holes formed on the handle portion when on one or both of the extended and retracted conditions of the needle. The orientation of the lug or lugs may be reversed with respect to the handle portion, and the positions of the recesses may be one opposite sides of the access aperture 84.

The handle portion 12 may include a polygonal section 86 in some embodiments (see FIGS. 25 and 26) which has a polygonal cross-sectional shape with a plurality of substantially planar sides. The number of sides may correspond to the number of loop segments 48 on the tool portion, and each of the sides may be aligned with one of the loop sections of the tool such that, for example, when one of the loop segments is oriented downwardly, the corresponding side is positioned in an upward orientation. A number of sides may correspond to a number of loop segments on the tool portion. Each of the sides of the handle portion may have at least one tactile indicator element 88 to permit the user of the tool to be able to distinguish by touch between the various sides and the various loop segments associated with the sides. Each of the sides may have a tactile indicator element 88 that is different from the indicator elements located on the other sides, such that the sides, and thus the loop segments, are tactilely distinguishable from each other using the indicator elements. Illustratively, the tactile indicator element comprises at least one bump protruding from the surface of the side of the handle portion, and each of the sides may have a different quantity or number of bumps than any other of the sides of the handle portion such that the user is able to touch the bumps and distinguish that side and that orientation from other sides and other orientations.

The finned sample spreading tool 42 may be employed to spread a sample over the upper surface of a nutrient agar (having a solidified gel form) in a Petri dish, and may provide multiple different surfaces on the tool for contacting and spreading a substance or culture over the agar surface. The tool 42 may be used to dilute a sample on a surface in a Petri plate in a manner that avoids the repetitive motions in conventional techniques in which (1) a needle tool is used to deposit and spread a sample on a small area of the surface; (2) the needle tool is pulled out of the Petri plate and sterilized (typically using heat in the flame of a Bunsen burner); (3) the needle tool is cooled; (4) the needle tool is again used to take a portion of the sample from the previous deposit on the plate and then spread to a new area of the plate; and repeating steps 1 through 3 for three or more times for each plate. The sample may thus be diluted over the surface of the agar nutrient in the plate. Instead, using the tool 42, the sample may be picked upon and placed and spread at one portion of the plate using one of the loop segments, and the tool 42 may be rotated approximately one-quarter turn so that a new loop segment can take a portion of the sample from the first deposit and spread the sample portion to a new portion of the plate. The tactile indicator elements on the handle may assist the user in being able to distinguish between the loop segments, including between unused and previously used loop segments. The sample spreading action can be repeated once for each of the loop segments without pulling the tool away from the plate surface to, for example, sterilize the surface for subsequent sample spreading and possibly causing contamination of the sample by inadequate sterilization between spreading actions or possibly bringing a hot tool into contact with and destroying the organism.

In another aspect, the disclosure relates to a sample manipulation tool 10 that comprises a sample picking tool 90 (see FIGS. 27 through 32) in which the tool portion includes a loop section 92 that is located toward the inboard end 18. The loop section 92 may be fixed to the handle portion, such as on the handle portion's first end 14. The loop section 92 may form a reservoir 94 in which liquids may be held through surface tension or other physical engagement. A portion of the loop section may have a generally circular cross-sectional shape. The loop section may have an outer perimeter 96, and in some embodiments at least a portion of the outer perimeter of the loop portion may be formed with an edge 98 that may extend outwardly from the outer perimeter 96 and the reservoir to assist in cutting into the agar material. The edge 98 may lie in a plane, and may be formed by an intersection of two substantially planar surfaces on the outer perimeter 96 when viewed in a cross-sectional plane (see, e.g., FIGS. 31 and 32).

The sample picking tool 90 may also include a hook section 100 which extends from the loop section 92. The hook section may have a first end 102 fixed to the loop section 92 and a second end 104 which is a free end located opposite of the loop section. In some embodiments, the hook section 100 may have an at least partially curved configuration with an arcuate section 106 which may help to minimize any gouging of the agar surface during sample manipulation. The direction of the curve of the arcuate extent 106 may be such that the hook section lies in a plane that is oriented substantially perpendicular to the plane in which the loop section lies. The hook section 100 may be mounted on and extend from the loop section at a location that is substantially opposite from the location where the loop section 92 connects to the handle portion 12.

The combination of the loop section and the hook section permits a user of the tool 90 to perform at least two different tasks, including picking up solid samples, such as microbial colonies, with the hook section and spreading it on a nutrient media as well as picking liquid samples, such as a microbial solution, with the loop section and dispersing it in liquid or solid nutrient media. The hook section permits the user to physically pick up samples having a more solid character, while the loop section permits the user to pick up a liquid sample and retain the sample through the mechanism of surface tension. The combination of the loop and hook sections on a single end of the tool keeps both of these tool elements in the same area or space, such as in the Petri dish or plate, so that the user does not have to be mindful of the position of a tool element on an opposite end of a handle when the other tool element is not being used. Additionally, the edge 98 that extends from the otherwise circular cross-section of the loop section may facilitate cutting into a nutrient agar positioned in a Petri dish to position a sample below the surface of the agar. The edge on the loop section may cut into the agar more cleanly rather than bluntly tearing into the surface of the agar, and the loop section may carry the sample into the cut made into the agar. The loop section may have different sizes (e.g., diameters) capable of carrying different predetermined volumes of a sample to the Petri plate and can cut into nutrient agar to deliver the sample into the nutrient agar without fracturing the solid media. A clean stab or cut of the nutrient agar may provide anaerobic conditions for the sample in the agar. Further, the curvature of the hook section, when employed, may facilitate the spreading of the sample on nutrient agar without gouging the surface of the agar.

In still yet another aspect of the disclosure, the sample manipulation tool comprises a sample scraping tool 110 (see FIGS. 33 through 42) which is configured to mount on a pipette 1 having a tip 2 with a hole 3 at the tip which extends into the hollow interior of the pipette 1. The pipette 1 has an exterior surface 4 with a tip portion that tapers narrower toward the tip 2. The tapered exterior surface of the tip portion of the pipette may have a substantially conical shape, while the exterior surface of the main portion of the pipette 1 may be substantially cylindrical in shape.

The tool portion 16 of the tool 110 may comprise a mounting structure 112 which is configured to mount on the pipette 1. The mounting structure 112 may be configured to receive a portion of the pipette, and may be configured to engage the exterior surface of the pipette such that the tool 110 is mounted on and carried by the pipette. The mounting structure 112 may be configured to mount on a substantially conical shaped tip portion of the exterior surface 4, and the mounting structure may define a hollow substantially cone-shaped interior which receives the substantially conical-shaped portion of the exterior surface of the pipette. Attachment of the mounting structure on a pipette may be accomplished by sizing the cone-shaped interior for a snug fit with the exterior surface of the pipette such that jamming the pipette end portion into the cone-shaped interior creates a connection. Optionally, a substance that creates a temporary adhesion between the parts may be employed. The mounting structure 112 may be tubular with opposite openings including a tip opening 114 through which the tip 2 of the pipette extends and is able to protrude, and may also include a back opening 116 through which the major portion of the pipette extends when the mounting structure 112 is mounted on the pipette 1. Different sizes of the mounting structure may be utilized for the variety of pipette sizes that are available.

The tool portion 16 may also include a scraper structure 118 which is configured to scrape a surface, such as plastic surfaces of a container and/or the upper surface of an agar material within a container. The scraper structure 118 may include an elongated scraping edge 120 extends along a portion of the length of the scraper structure. The scraper structure may be provided in a variety sizes to accommodate different sizes of containers and different types of samples.

The tool portion may also include a connection structure 122 which connects the scraper structure 118 to the mounting structure 112 in a manner that permits movement of the scraper structure with respect to the mounting structure and a pipette on which the mounting structure is mounted. The connection structure 122 may permit swivel movement of the scraper structure with respect to the mounting structure and may also permit rotational movement therebetween. The connection structure 122 may comprise a ball 124 and a socket 126 (see FIGS. 40 through 42), with the ball being mounted on the mounting structure and the socket being formed on the scraper structure. The ball 124 may have at least one notch 128 formed on the surface of the ball for removably receiving at least one rib 130 formed on the socket to releaseably lock a position of the scraper structure with respect to the mounting structure (although the positions of the notch and rib may be reversed with respect to the ball and socket). The rib 130 and the notch 128 may be arranged on the structures such that a detent relationship is provided for maintaining the scraper structure in at least one orientation with respect to the mounting structure. The ball and socket may be in a tight snap fit relationship that enhances the ability of the rib and notch to hold an orientation of the scraper with respect to the connection structure. Illustratively, the orientation may be characterized by a longitudinal axis of the scraper structure being oriented substantially parallel to a longitudinal axis of the pipette. Optionally, the orientation may be characterized by the longitudinal axis of the scraper structure being oriented perpendicular to the longitudinal axis of the pipette. In some embodiments, the location of the socket 126 on the scraper structure 118 may be offset from a midpoint of the length of the scraper structure such that an eccentric relationship is enabled.

The sample scraping tool, when mounted on the end of a pipette, facilitates the use of a pipette to withdraw material from the interior of a container, such as a tissue culture (TC) flask. The sample scraping tool is attached to the end of the pipette by pushing the pipette into the mounting structure 112 through the back opening typically to a point at which the tip of the pipette reaches the tip opening 114 of the structure 112. The scraping edge 120 of the scraper structure is movable and rotatable, and may even be swivelable, so that the edge 120 may be positioned at a large range of angles once the tool 110 has been moved inside a tissue culture flask. The adjustability of the scraper structure enhances access to virtually all areas of the container interior. The sample, such as cells, is scraped from a surface in the container, such as the surface of tissue culture media, and then removed using the pipette. These actions may be repeated a number of times without removing the tool from the interior of the container. Thus, the scraping and removal (such as by aspiration using the pipette) may be accomplished without using two different tools at different times, and may also be accomplished without removing the tool from the container interior between the scraping and removal operations. The speed and efficiency of the operations are also significantly increased.

It should be appreciated that in the foregoing description and appended claims, that the terms "substantially" and "approximately," when used to modify another term, mean "for the most part" or "being largely but not wholly or completely that which is specified" by the modified term.

Each of the tools described may be formed out of a suitable plastic material that may be sterilized before and after use, although it is contemplated that in many applications the tool may be disposed after a single use.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps disclosed in the text and/or the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A sample spreading tool comprising a handle portion being elongated and having a first end and a second end;

a tool portion at the second end of the handle portion, the tool portion having an inboard end and an outboard end with the inboard end being connected to the second end of the handle portion, a central longitudinal axis of the tool portion extending between the inboard and outboard ends;

wherein the tool portion comprises:

a central element extending from the inboard end to the outboard end of the tool portion; and at least two loop segments connected to the central element at substantially opposite positions with respect to the central longitudinal axis, each of the loop segments having an inner end connected to the central element at the inboard end of the tool portion and an outer end connected to central element at the outboard end of the tool portion, each of the loop segments having a section with a substantially arcuate shape between the inner and outer ends;

wherein the tool portion has a lateral width measured perpendicular to the central longitudinal axis, the lateral width of the tool portion increasing in magnitude substantially uniformly from the inboard end of the tool portion toward the outboard end of the tool portion;

wherein the handle portion has a polygonal section with a polygonal cross sectional shape with a plurality of sides, a number of sides corresponding to a number of loop segments on the tool portion, each of the sides being aligned with one of the loop segments such that when one of the loop segments is oriented downwardly a corresponding side is positioned in an upward orientation.

2. The tool of claim 1 wherein the tool portion has an inner section and an outer section, the inner section and the outer section of each one of the loop segments forming a partial triangle with the central element of the tool portion.

3. The tool of claim 1 wherein the at least two loop segments comprises four loop segments arranged in pairs of loop segments in substantially opposite positions with respect to the central longitudinal axis such that the four segments effectively form two complete loops, the two loops being oriented in perpendicular planes to each other.

4. The tool of claim 1 wherein each of the outer ends of the loop elements is connected to the central element at an endmost point of the outboard end of the tool portion.

5. The tool of claim 1 wherein the sides of the handle portion have at least one tactile indicator element thereon different from indicator elements on other sides.

6. The tool of claim 5 wherein the tactile indicator element comprises a bump protruding from the surface of the side of the handle portion.

7. The tool of claim 6 wherein each of the sides has a different quantity of bumps than the other sides of the handle portion.

8. A sample spreading tool comprising:

a handle portion being elongated and having a first end and a second end;

a tool portion at the second end of the handle portion, the tool portion having an inboard end and an outboard end with the inboard end being connected to the second end of the handle portion;

wherein the tool portion comprises:

a central element extending from the inboard end to the outboard end of the tool portion, a passage extending through the central element from the inboard end to the outboard end of the tool portion and an outboard opening at the outboard end;

at least two loop segments connected to the central element, each of the loop segments having an inner end connected to the central element at the inboard end of the tool portion and an outer end connected to central element at the outboard end of the tool portion, each of the loop segments having a substantially arcuate shape between the inner and outer ends; and a sample needle positioned in the passage of the tool portion and having a tip end and an interior end, the sample needle being movable between an extended condition and a retracted condition, the extended condition being characterized by the tip end of the needle protruding from the central element and the outboard opening at the outboard end of the tool portion, the retracted condition being characterized by the tip end being retracted into the central element such that the tip end does not protrude from the outboard opening at the outboard end;

wherein the sample needle has a tip portion extending from the tip end toward the interior end, the tip end having a domed shape and the tip portion having a substantially cylindrical shaped surface, a recess extending into the substantially cylindrical shaped surface of the tip portion at a location spaced from the tip end; and wherein a diameter of the tip portion is slightly smaller than a diameter of the outboard opening in the central element such that the tip portion fits snugly in the passage of the central element.

9. The tool of claim 8 wherein the sample needle includes a lock structure being formed on the sample needle to releasably hold the sample needle in at least the extended condition.

10. The tool of claim 9 wherein the lock structure is configured to releasably hold the sample needle in the retracted condition.

11. The tool of claim 8 wherein the handle portion has an interior passage in communication with the passage of the central element; and wherein the sample needle includes an actuation handle located toward the interior end of the sample needle, the actuation handle being accessible through an access aperture in the handle portion for finger actuation by a user of the tool.

12. The tool of claim 8 wherein the sample needle includes a sample pickup facilitating structure formed on the sample needle toward the tip end.

13. The tool of claim 12 wherein the sample pickup facilitating structure on the sample needle comprises a cup formed by a recess extending into the sample needle.

* * * * *